United States Patent [19]

Cicci

[11] Patent Number: 4,836,102

[45] Date of Patent: Jun. 6, 1989

[54] INK TRANSFER WITH PARTIAL CURING

[75] Inventor: Thomas Cicci, Columbia, Md.

[73] Assignee: Fusion Systems Corporation, Rockville, Md.

[21] Appl. No.: 103,160

[22] Filed: Oct. 1, 1987

[51] Int. Cl.[4] ..... B41M 1/00; B41M 7/00; B41F 17/00

[52] U.S. Cl. ..... 101/41; 101/450.1; 101/424.1; 101/488

[58] Field of Search ..... 101/35, 41, 163, 170, 101/426, 463, 450.1, 177, 416 A

[56] References Cited

U.S. PATENT DOCUMENTS

| | | | |
|---|---|---|---|
| 1,511,816 | 10/1924 | Marston | 524/313 |
| 2,109,774 | 3/1938 | Hooft | 101/416 R |
| 2,268,594 | 1/1942 | Huber | 101/426 |
| 2,384,039 | 9/1945 | Miglarese | 101/426 |
| 2,486,259 | 10/1949 | Chavannes | 101/426 |
| 2,735,364 | 2/1956 | Muller | 101/142 |
| 3,962,489 | 6/1976 | Ritzerfeld | 101/469 |

FOREIGN PATENT DOCUMENTS

| | | | |
|---|---|---|---|
| 2435251 | 2/1976 | Fed. Rep. of Germany | 101/177 |
| 1019481 | 2/1966 | United Kingdom | 101/426 |

*Primary Examiner*—Clyde I. Coughenour
*Attorney, Agent, or Firm*—Pollock, Vande Sande & Priddy

[57] ABSTRACT

A process for printing in which a layer of ink on an ink transfer pad is cured at the interface between the ink layer and the pad and left substantially uncured at the outer surface to provide a tacky surface for contact of the ink layer with a printable substrate. The partially cured ink layer is thus easily transferred from the ink transfer pad to the printable substrate by bringing the tacky surface into contact with the substrate. Inks which contain an oxygen-inhibited resin such as acrylates and unsaturated polyesters, and which are treated with long wavelength ultraviolet light, selectively cure at the interface of the ink layer and the transfer pad.

14 Claims, 2 Drawing Sheets

INK TRANSFER WITH PARTIAL CURING

FIELD OF THE INVENTION

This invention relates to methods of printing and more specifically to methods of transferring ink from an inked, patterned surface to a printable substrate.

BACKGROUND OF THE INVENTION

In one method of printing, a design, or a portion of a design, is transferred from a printing plate to a printable substrate inking a surface of the printing plate, tranferring the pattern of ink to an intermediate, print-retaining body, or print pad, by pressing the surface of the print pad against the inked surface so that ink transfers to the pad, and then pressing the inked surface of the pad against the substrate to be printed.

A successful process requires substantially complete transfer to the ink from the printing plate to the print pad, and then from the print pad to the printable substrate. A complete transfer of ink in each step requires a proper balance of adhesion froces between (1) the printing plate and the ink, (2) the ink and print pad, and (3) the ink and the printable substrate. If the ink is formulated to transfer well to the pad, its complete transfer from the pad is made more difficult. Chemical solutions to the problem of balancing the relative adhesive forces between ink and the printing plate, the print pad and the printable substrate require a careful selection of materials, and may result in sacrificing some print quality in the finished printed product.

Another difficulty with chemical solutions to the problems of ink transfer is that different substrates may require different ink formulations. For example, U.S. Pat. No. 4,388,137 to McCarty et al, describes coatings which are specifically designed to provide a desired degree of differential adhesion to cling to different surfaces by controlling (1) the density of cross-linking in the coatings, (2) the presence of adhesion-promoting sites in the coating, and (3) the glass transition temperature of the coating.

A method of printing by transferring ink from one surface to another which does not require a delicate balance between the adhesive properties of an ink with respect to the surfaces from which and to which it is to be transferred, is desirable.

SUMMARY OF THE INVENTION

It is accordingly one object of this invention to provide a process for printing in which ink is readily transferred between a surface carrying a layer of ink and a substrate to be printed.

It is another object of this invention to provide a process for printing which does not rely on achieving a delicate balance between adhesive forces between wet ink and surfaces to and from which it is to be transferred.

It is still another object to provide a process for printing in which changes in adhesive properties of the ink are altered during the printing process.

In accordance with the invention, there is provided a process for printing a printable substrate comprising inking a patterned surface with a layer of a wet, radiation-curable ink, and then transferring the patterned layer of ink to the ink transfer surface of a print pad. The layer of ink on the pad is then exposed to radiation under conditions which will cure the ink at the interface of the ink layer and the transfer surface of the print pad to a greater extent than at the outer surface of the ink layer, which remains tacky. The tacky surface of the ink on the print pad is then brought into contact with the substrate to be printed and the ink layer transfeers from the pad to the printable substrate. The ink which has been transferred to the printable substrate may then be further cured, as by radiation, or with some formulations, the ink may be left to cure without the use of external agents.

This invention permits the use of a wide variety of ink formulations and surface materials in contact with the ink. However, the ink must be formulated to transfer efficiently from the inked plate to the transfer pad, and ink in contact with the transfer surface of the print pad must be curable to a greater extent than the portion of ink which is to contact the printable substrate in order to permit ready release of the ink from the pad to the printable substrate.

As used herein, the following terms are defined as follows:

"Tacky"—having the quality of being adhesive or sticky;

"Low Energy Surface"—a surface which has low molecular attraction forces for other materials, especially adhesives and other organic polymers;

"Oxygen-Inhibited"—the tendency not to cure or polymerize in the presence of oxygen or air.

DETAILED DESCRIPTION OF THE INVENTION

Figure 3:
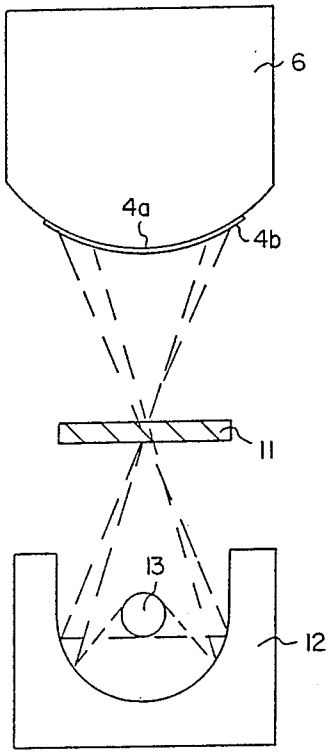
FIG. 3 is a schematic side elevation view illustrating the step of selectively curing the layer of ink on the ink transfer pad using ultraviolet radiation.

Referring to the drawings, in the first step of carrying out this invention, the ink in a desired pattern is transferred from the inked surface 2 of printing plate 1 to a low energy surface 5 of ink transfer print pad 6. As shown in FIG. 3, the ink layer 4 on surface 5 is subjected to radiation from a source 13 via reflector 12 and filter 11. The radiation of ink layer 4 results in inner surface **4*a* of ink being cured to a greater extent than the outer surface 4*b*. In the next step of the process, the ink is transferred to printable surface 10 of substrate 8 by bringing the inked portion on ink transfer body 6** into contact with the substrate.

This invention requires that the ink at the interface between the ink layer and the ink transfer pad, i.e., the ink at **4*a*, be cured to a greater extent than the ink at the outer layer (4*b*). This cure at 4*a* results in a reduction of the adhesion of the ink layer to the ink transfer print pad, and a release of the ink layer from the printed pad when the tacky, substantially uncured outer surface 4*b*** of the ink layer comes in contact with the printable substrate.

In the preferred method of carrying out the invention, the selective curing is accomplished by (1) the use of an oxygen-inhibited radiation-curable ink, and (2) the selection of radiation for curing which will cure the ink in the presence of oxygen to a lesser extent than in the absence of oxygen. Typically useful radiation sources are electron beams and ultraviolet sources, and the preferred source is an ultraviolet source.

This invention also comtemplates the selective curing of the inner surface 4a of the ink by providing catalysts or polymerization promoters for the ink in contact with the ink transfer surface. In this aspect of the invention, the catalyst or polymerization promoters must not be present to a significant extent at the outer surface (e.g., at 4b) of the ink layer. Selective doping of the ink layer with catalysts or polymerization promoters may be achieved by wetting the ink transfer surface 5 of the print pad with a catalytic or polymerization agent before transferring ink from the printing plate 2 to pad 5. The ink on the pad is then exposed to radiation which is capable of curing the ink in the presence of the catalyst or polymerization promoter.

The radiation is carried out until the ink at the interface is sufficiently cured so that contact of the outer, still tacky layer 4b of ink with the printable substrate will result in stronger adhesion of the ink layer to the substrate than to the ink transfer print pad.

If the practice of the invention is to be based on the use of oxygen-inhibited inks, any of the inks which do not polymerize completely in the presence of oxygen may be used. For example, the polymerization of acrylates is sensitive to the presence of oxygen, and the oxygen present in air will retard or even prevent polymerization of acrylic compositions and a tacky incompletely polymerized resin is obtained in the presence of oxygen.

Unsaturated polyester resins also tend to be air-inhibited, and inks containing these resins are useful in this invention.

In using oxygen-inhibited inks to carry out this invention, the preferred radiation source is energy in the 200 to 450 nanometer range, and preferably in the 400–450 nanometer range. While ultraviolet sources having an ultraviolet wavelength as low as about 200 nanometers could be used in some instances, such as, for example, with inks which are highly oxygen-inhibited, the tendency is strong for ultraviolet at such short wavelengths to cure even the surface of ink which is exposed to oxygen.

Figure 1:
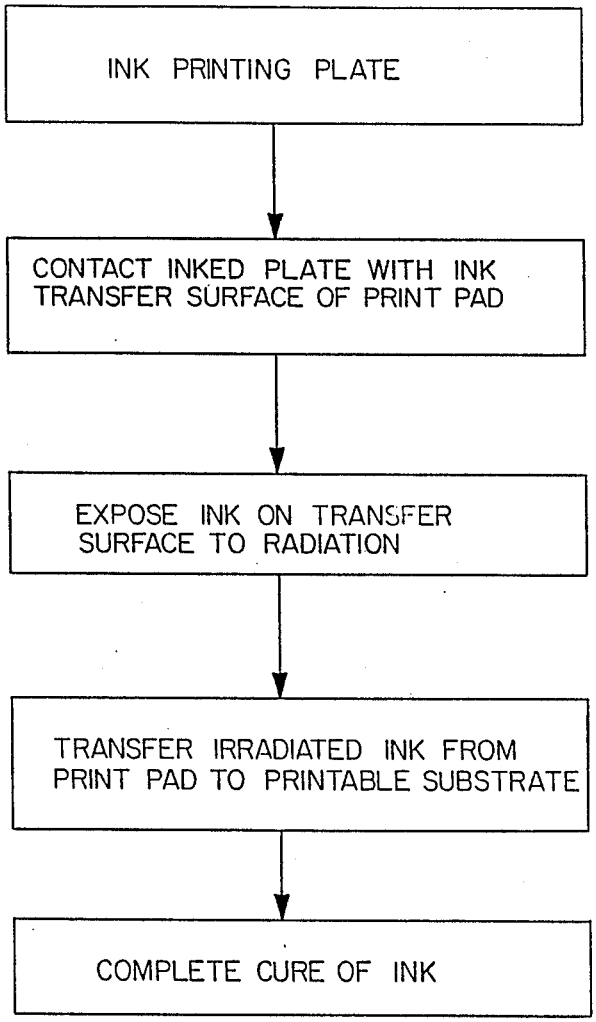
FIG. 1 is a diagram showing the sequence of steps in the present process.
Figure 4:
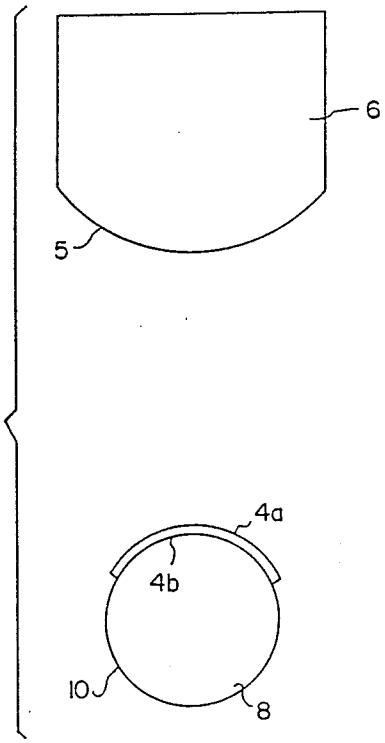
FIG. 4 is a schematic side elevation view showing the ink on a printed substrate after its contact with the substrate and subsequent release from the ink transfer pad.

A particular advantage of employing oxygen-inhibited resins in the practice of this invention lies in the fact that the tacky surface which is uncured in the step shown in FIG. 3 is shielded from oxygen after transfer of the ink layer to the printable substrate (see FIG. 4), and can thus be readily cured under the same radiation conditions as those used in the preceding step.

The ink transfer pad preferably has a low energy surface and is one which is not capable of co-polymerizing with the ink in the presence of the radiation to which it is subjected in the selective curing step. The preferred materials for the ink transfer pad are the silicones; however, other low surface energy materials which are capable of lifting ink from the ink plate in the step shown in FIG. 2, may be used.

As noted above, the preferred source of energy is a light source having its principal output in the range of 200 to 450 nanometers. Typically useful UV sources for radiation in this range are the F450, F200 amd AEL1B models, available from Fusion Systems, Inc. If the radiation source produces too high a level of short wavelength UV, filters may be used to block those wavelengths which would tend to polymerize the outer surface 4b of the ink layer.

This process results in the clean transfer of ink from the ink transfer surface to the printable substrate and the ink which is transferred has an outer ink surface which is cured. The cured surface can accept additional coats of ink in different colors without intermediate steps of curing, although a final cure may be necessary if the ink is not formulated to post-cure.

Having thus described the present invention, the following Examples are offerred to illustrate it in more detail. Example I describes a printing process in which the ink on the print pad is not exposed to radiation, and Example II describes a printing process in which the ink on the print pad is irradiated.

EXAMPLE I

Figure 2:
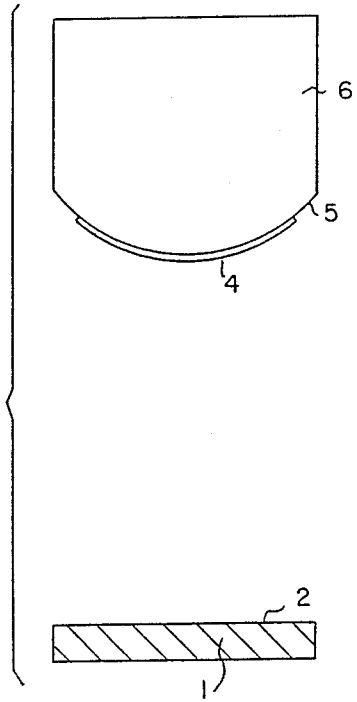
FIG. 2 is a schematic side elevation view illustrating the layer of ink on the ink transfer pad aafter its transfer from the printing plate.

In carrying out this printing process, a commercially available UV curable screenprint ink identified as Narcote Opaque White #01-002 is coated onto a print plate and transferred to a print pad as shown in FIG. 2. The print pad is then brought into contact with a printable substrate (expanded polyethylene). The ink transfers satisfactorily to the print pad, but smears and only partially transfers from the print pad to the printable substrate.

EXAMPLE II

The printing process of Example I is carried out with the addition of a step of irradiating the ink while it is on the print pad, as shown in FIG. 3. An F450-10 Fusion Systems UV curing system with a V-bulb installed is used to effect a partial cure of the ink. The v-bulb emits 80% of its usable energy in the 400 to 450 nm range. The ink pad is moved past the curing system on a conveyor belt moving at a speed of about 70 feet per minutes. The outer surface of the ink (surface 4b as shown in FIG. 3) remains tacky, and the ink is completely transferred from the print pad to the printable substrate.

The foregoing is intended to illustrate, not limit, the invention which may readily be modified by workers in the art, and the invention is limited only by the claims appended hereto and equivalents.

What is claimed is:

1. A process for printing a printable substrate comprising:

(a) inking a patterned surface of a printing plate with a wet, radiation-curable ink;

(b) contacting the resulting inked surface with an ink transfer surface of a print pad under conditions which result in a transfer of ink from said surface of said printing plate to said ink transfer surface to form a patterned layer of ink thereon;

(c) exposing the resulting layer of ink on said ink transfer surface to radiation and providing conditions under which said radiation is carried out to cure the ink at the interface of said ink layer and said transfer surface of said print pad to a greater extent than at the outer surface of said ink layer; and (d) bringing the outer surface of the resulting partially-cured ink-layer on said transfer surface into contact with said printable substrate, whereby said patterned layer of ink transfers from said pad to said printable substrate.

2. The process according to claim 1, wherein the ink at said interface is substantially completely cured in step (c).

3. The process according to claim 1, wherein the ink at the outer surfacce is tacky at the completion of step (c).

4. The process according to claim 1, wherein the ink which has been transferred to the printable substrate is exposed to radiation which will further cure said ink.

5. The process according to claim 1, wherein the ink comprises an oxygen-inhibited resin.

6. The process according to claim 1, wherein the ink comprises at least one resin selected from the group consisting of polyacrylates and unsaturated polyesters.

7. The process according to claim 1, wherein the ink comprises a polyacrylate.

8. The process according to claim 1, wherein said radiation is energy with a wavelength in the range of 200 to 450 nm.

9. The process according to claim 1, wherein the ink is ultraviolet-curable and said radiation is ultraviolet.

10. The process according to claim 1, wherein said radiation comprises a beam of electrons.

11. The process according to claim 1, wherein said print pad comprises a low energy surface.

12. The process according to claim 1 wherein said ink transfer surface comprises a silicone.

13. The process according to claim 1, wherein steps (a), (b), (c) and (d) are carried out a plurality of times to print a plurality of patterned layers of ink onto said substrate and the resulting composite is cured.

14. The process according to claim 13 wherein the composite is cured with radiation.

* * * * *